United States Patent [19]

Taniguchi

[11] 4,403,586

[45] Sep. 13, 1983

[54] FUEL INJECTION PUMP OF INTERNAL COMBUSTION ENGINE

[75] Inventor: Hiroyuki Taniguchi, Otsu, Japan

[73] Assignee: Yanmar Diesel Engine Co., Ltd., Osaka, Japan

[21] Appl. No.: 167,463

[22] Filed: Jul. 11, 1980

[30] Foreign Application Priority Data

| | | | |
|---|---|---|---|
| Dec. 11, 1979 | [JP] | Japan | 54-172046[U] |
| Dec. 11, 1979 | [JP] | Japan | 54-172047[U] |
| Dec. 17, 1979 | [JP] | Japan | 54-175384[U] |
| Dec. 17, 1979 | [JP] | Japan | 54-175385[U] |
| Dec. 18, 1979 | [JP] | Japan | 54-175910[U] |
| Dec. 18, 1979 | [JP] | Japan | 54-175911[U] |
| Dec. 26, 1979 | [JP] | Japan | 54-183206[U] |
| Dec. 28, 1979 | [JP] | Japan | 54-183217[U] |
| Dec. 28, 1979 | [JP] | Japan | 54-183218[U] |

[51] Int. Cl.[3] ..... F02M 39/02

[52] U.S. Cl. ..... 123/509; 123/468; 417/DIG. 1

[58] Field of Search ..... 123/509, 508, 501, 468; 417/499, DIG. 1

[56] References Cited

U.S. PATENT DOCUMENTS

| | | | |
|---|---|---|---|
| 3,759,637 | 9/1973 | Vuaille | 123/495 |
| 4,286,931 | 9/1981 | Häfele | 417/499 |

FOREIGN PATENT DOCUMENTS

| | | | |
|---|---|---|---|
| 2213806 | 9/1972 | Fed. Rep. of Germany | 123/509 |
| 1231186 | 5/1971 | United Kingdom | 123/509 |

*Primary Examiner*—Charles J. Myhre
*Assistant Examiner*—Carl Stuart Miller
*Attorney, Agent, or Firm*—Charles A. Blank

[57] ABSTRACT

A fuel injection pump including a pump body formed with a plunger sliding bore, and a discharge valve mounted on one end portion of the plunger sliding bore corresponding to an upper end portion of a plunger so that said end portion of the plunger sliding bore functions as a guide for the discharge valve. This arrangement enables the plunger barrel and discharge valve guide member of a fuel injection pump of the prior art to be dispensed with and permits the number of the parts of the pump, the size of the pump, the weight of the pump and the production to be reduced.

3 Claims, 8 Drawing Figures

FUEL INJECTION PUMP OF INTERNAL COMBUSTION ENGINE

This invention relates to a fuel injection pump suitable for use with an internal combustion engine.

In one type of fuel injection pump known in the art, particularly a Bosch type pump, a barrel for receiving a plunger and a discharge valve guide member for mounting a discharge valve are secured in a pump body. In this case, there arises the problem that the fuel might leak between the barrel and the discharge valve guide member and the weight of the pump increases with an increase in the number of parts. Also, the discharge valve guide member should be attached to the pump body while the discharge valve is being mounted on its guide member, thereby rendering the discharge valve mounting structure complex in construction.

A first object of this invention is to provide a fuel injection pump of an internal combustion engine wherein a pump body is formed with a plunger sliding bore having a discharge valve mounted at an end thereof which corresponds to the top of a plunger so that the discharge valve may be guided by such end of the plunger sliding bore, whereby the barrel and the discharge valve guide member used in this type of fuel injection pump of the prior art can be dispensed with and the number of parts of the pump can be reduced, to enable the overall size and weight of the pump to be reduced and permit the discharge valve mounting structure to be rendered simple in construction.

A second object is to form, in a fuel injection pump of the aforesaid construction, a spring seat for a plunger returning spring and a flange for positioning the pump body with respect to an engine body integral with the pump body, to thereby reduce the number of parts and obtain an overall compact size in a fuel injection pump.

A third object is to connect, in a fuel injection pump of the first-mentioned construction, the pump body with the plunger through a plunger returning spring into a unitary structure by a simple construction, so that the number of parts can be reduced and the size of the pump can be reduced while insertion into and withdrawing from the engine body of the pump is facilitated when assembling and disassembling are effected.

A fourth object is to provide, in a fuel injection pump of the type in which the pump body and the plunger are rendered into a unitary structure, a spring support structure for the plunger returning spring which enables the plunger to move smoothly in vertical sliding movement and rotary movement.

A fifth object is to provide, in a fuel injection pump of the first-mentioned construction, an injected fuel metering mechanism by utilizing a portion of a plunger actuating tappet, to thereby reduce the number of parts and the size of the pump.

A sixth object is to form, in a fuel injection pump of the first-mentioned construction, a disk-shaped flange on the pump body which is forced against the engine body by a plate member and secured thereto, so that the pump body can have its size reduce, working can be facilitated and the space required for mounting the pump can be reduced.

A seventh object is to provide, in a fuel injection pump of the first-mentioned construction, a simplified fuel line mounting structure.

The invention may be carried into practice in various ways but several specific embodiments will now be described, by way of example, with reference to the accompanying drawings, in which.

Figure 1:
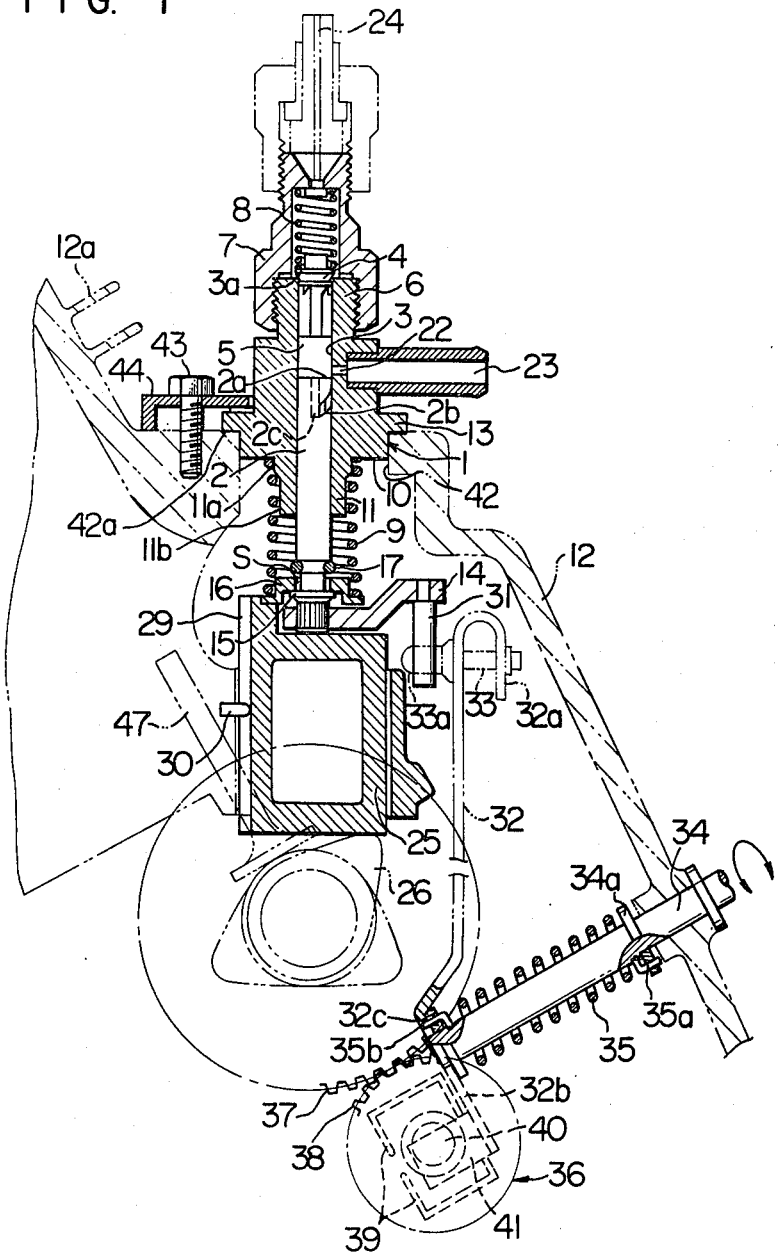
FIG. 1 is a sectional view of the fuel injection pump comprising one embodiment of the invention.
Figure 2:
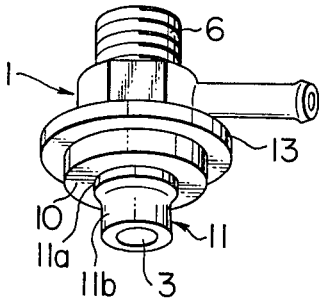
FIG. 2 is a perspective view of the pump body of the fuel injection pump shown in FIG. 1.

In FIGS. 1 and 2, the numeral 1 designates a pump body of the fuel injection pump comprising one embodiment of this invention which is formed as a single entity from case-hardening steel [chromium-molybdenum steel SCM21 of JIS (Japanese Industrial Standard)], bearing steel (SUJ2 or SUF3 of JIS) or nitriding steel which can be subjected to hardening treatment. The pump body 1 is formed with a plunger sliding bore 2 for permitting a plunger 2 to move in sliding movement therein, so that the pump body 1 will serve concurrently as a barrel for permitting the plunger to move in sliding movement. The plunger sliding bore 3 has its inner peripheral surface hardened when the outer peripheral surface of the pump body 1 is hardened.

The plunger sliding bore 3 into which the plunger 2 is inserted from below includes an end portion 3*a* corresponding to an upper portion 2*a* of the plunger 2 which functions as an opening for slidably mounting a discharge valve 4. The receiving opening at the end portion 3*a* may have a diameter distinct from the inner diameter of the plunger sliding bore 3.

The plunger sliding bore 3, the upper portion 2*a* of the plunger 2 and the discharge valve 4 define a chamber 5, and the plunger 2 has an oblique groove 2*b* on its outer periphery. The chamber 5 is maintained in communication with the oblique groove 2*b* through a passage 2*c* extending downwardly from the center of the plunger upper portion 2*a* and then extending radially outwardly to open in the oblique groove 2*b*.

The pump body 1 includes an externally threaded upper portion 6 formed integrally therewith, and the discharge valve 4 fitted in the end portion 3*a* of the plunger sliding bore 3 serving as a receiving opening is maintained in a closed position by the biasing force of a discharge valve spring 8 mounted in the interior of a discharge valve retaining collar 7 threadably fitted over the upper cylindrical portion 6.

The pump body 1 includes a lower end serving as a spring seat 10 for a plunger returning spring 9 and has a cylindrical guide 11 extending downwardly integrally from the center of the spring seat 10.

The guide cylinder 11 has an outer peripheral surface including an annular engaging surface 11*a* of a diameter slightly larger than the inner diameter of the plunger returning spring 9 extending downwardly from the spring seat 10, and a guide surface 11*b* of a diameter substantially equal to the inner diameter of the plunger returning spring 9 extending further downwardly from the annular engaging surface 11*a*. Simultaneously as the plunger sliding bore 3 is hardened as described hereinabove, the spring seat 10, annular engaging surface 11*a* and guide surface 11*b* are hardened.

The pump body 1 is formed on its outer periphery in a position above the spring seat 10 with a flange 13 for positioning the pump body 1 with respect to an engine body 12.

The plunger returning spring 9 is force fitted at one end portion thereof over the annular engaging surface 11*a* so that the former is secured to the pump body 1.

Meanwhile the plunger 2 has secured to its lowermost end a lever 14 for operating the plunger 2 in rotary movement, and a spring rest 16 is loosely fitted over a flange 15 formed on the plunger 2 in a position immediately above the lever 14. A ring 17 for preventing dislodging of the plunger 2 is mounted immediately above the spring rest 16 so that the latter is loosely fitted over the plunger 2 and held in place between the flange 15 and ring 17.

The spring rest 16 has an outer diameter slightly larger than the inner diameter of the plunger returning spring 9 so that the latter can be secured to the former by force fitting the other end portion thereof over the former.

Thus the plunger 2 is resiliently connected to the pump body 1 to form a unit therewith through the plunger returning spring 9.

Figure 3:
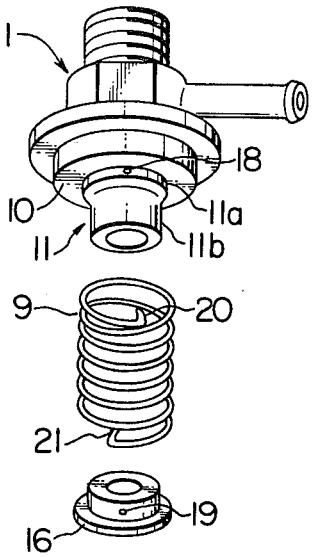
FIG. 3 is an exploded perspective view showing a modification of the essential portions of the fuel injection pump shown in FIG. 1.

FIG. 3 shows a modification of the arrangement for connecting the plunger 2 to the pump body 1 as a unit through the plunger returning spring 9. In this modification, the annular engaging surface 11*a* in the lower portion of the pump body 1 is formed with a spring securing recess 18 which may be a hole, cutout or groove, and the spring rest 16 is also formed on its outer periphery with a similar spring securing recess 19. The plunger returning spring 9 is formed integrally at its upper and lower ends with radially inwardly bent portions 20 and 21 respectively.

The plunger returning spring 9 is force fitted at its upper and lower end portions over the outer peripheral surfaces of the annular engaging portion 11*a* of the guide cylinder 11 of the pump body 1 and the spring rest 16 respectively so as to be frictionally held in place. At the same time, the plunger 2 can be positively connected resiliently to the pump body 1 to provide a unitary structure by fitting the bent portions 20 and 21 at the upper and lower ends of the plunger returning spring 9 in the engaging recess 18 on the annular engaging surface 11*a* of the pump body 1 and the engaging recess 19 on the outer periphery of the spring rest 16 respectively.

Referring to FIG. 1 again, 12*a* is a cylinder of the engine. The pump body 1 is formed with a fuel introducing and returning port 22 and has a fuel passage 23 connected to the port 22. 24 is a fuel injection tube, and 47 is a tappet for a suction and exhaust valve of the engine.

The fuel injection pump of the aforesaid construction is mounted on the engine body 12 in such a manner that the spring rest 16 is positioned against an upper surface of a tappet 25 mounted on the engine body 12, so that a cam shaft 26 maintained in engagement with the undersurface of the tappet 25 at all times by the biasing force of the plunger returning spring 9 rotates to move the tappet 25 vertically to enable the plunger 2 to move in reciprocatory movement through the bore 3.

Figure 4:
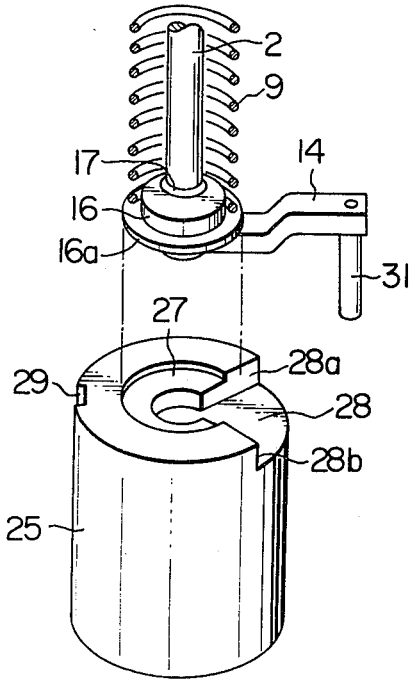
FIG. 4 is an exploded perspective view showing another essential portions of the fuel injection pump shown in FIG. 1.

As clearly shown in FIG. 4, the tappet 25 is formed on its upper surface with a recess 27 for receiving an outer perihery 16*a* of the spring rest 16, and an arcuate notch 28 extending radially outwardly from the center of the recess 27 to diverge toward the outer periphery of the tappet 25.

The notch 28 receives therein the lever 14 attached to the lower end of the plunger 2 for pivotal movement. The notch 28 is formed with opposite ends 28*a* and 28*b* which restrict the range of pivotal movement of the lever 14 or angular rotation of the plunger 2 supporting the lever 14 so that the upper limit and the lower limit of the amount of fuel injected can be regulated.

As shown in FIG. 1, the tappet 25 is mounted on the engine body 12 for vertical movement and formed on its outer periphery with an axial groove 29 for receiving a pin 30 secured to the engine body 12, to prevent the tappet 25 from rotating while allowing its vertical movement.

With the pump body 1 mounted on the engine body 12 as shown in FIG. 1, the lever 14 is engaged in the notch 28 on the upper end of the tappet 25 and the spring rest 16 is fitted in the recess 27 on the upper surface of the tappet 25.

Thus rotation of the cam shaft 26 moves the tappet 25 and spring rest 16 vertically as a unit. At this time, the spring rest 16 is prevented from moving radially by the recess 27, so that an annular space S is formed at all times between the outer periphery of the plunger 2 and the inner periphery of the spring rest 16 as shown in FIG. 1. By this arrangement, the plunger 2 can be readily operated by the lever 14 to rotate angularly even when the plunger 2 is moving in vertical reciprocatory movement, to readily and smoothly effect control of the amount of the injected fuel.

The lever 14 supports at its outer end a pin 31 which extends downwardly to be received in a bifurcated portion 33*a* of a member 33 secured to an upper end portion 32*a* of the inverted U-shape of a governor lever 32 as shown in FIG. 1.

In FIG. 1, the engine body 12 supports a rotatable shaft 34 which in turn supports on its inner end portion a bent lower end portion 32*b* of the governor lever 32 so that the latter can rotate with the rotatable shaft 34 about its axis. A coil spring 35 has ends 35*a* and 35*b* secured on a spring rest 34*a* mounted on the shaft 34 and in a small opening 32*c* formed in the lower end portion 32*b* of the governor lever 32 respectively.

In FIG. 1, 36 is a governor body, and 37 and 38 are gears for driving the governor body 36. 39 designates governor centrifugal weights extending from the governor body 36 downwardly from the plane of FIG. 1. 40 is a thruster activated by the governor centrifugal weights 39. A lug 41 projects from the lower end portion 32*b* of the governor lever 32 at right angles thereto into engagement with the top of the thruster 40. Rotation of the rotary shaft 34 in either of the directions indicated by arrows moves the governor lever 32 in pivotal movement about the shaft 34 through the coil spring 35, to thereby rotate the plunger 2 through the member 33, pin 31 and lever 14. Thus positioning of the governor lever 32 and plunger 2 is effected, to thereby make the torsional biasing force of the coil spring 35 determined by the degree of angular rotation of the shaft 34 match the expanding force of the governor centrifugal weights 39 through the thruster 40.

When the engine speed increases, the governor centrifugal weights 39 are expanded to bring the thruster 40 into contact with the lug 41, to thereby move the governor lever 32 counterclockwise in pivotal movement about the axis of the shaft 34. This rotates the plunger 2 clockwise and decreases the distance between the oblique groove 2b and the fuel returning port 22, so that termination of fuel injection is advanced and the amount of injected fuel is reduced. This decreases the engine speed to a predetermined number of revolutions.

Figure 5:
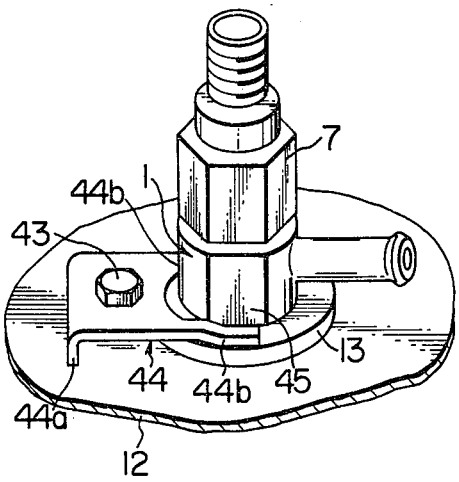
FIG. 5 is a perspective view of the upper portion of the fuel injection pump shown in FIG. 1, showing a mounting structure for the pump.

The structure for mounting the fuel injection pump on the engine body 12 will now be described by referring to FIGS. 1, 5 an 6. In FIGS. 1 and 5, the fuel injection pump is shown as being mounted on the engine body 12 in such a manner that the tappet 25 is in engagement with the cam shaft 26 and the flange 13 of the pump body 1 is positioned against an edge portion 42a of a mounting opening 42 formed in the engine body 12 in a position above the cam shaft 26.

In the aforesaid mounting structure, the lower end portion of the plunger 2 and the spring rest 16 are positioned against the upper surface of the tappet 25. As shown in FIG. 5, the flange 13 is secured in place by being pressed by a plate member 44 bolted to the engine body 12 as shown at 43.

In the aforesaid mounting structure, the plate member 44 is formed at one end thereof with a leg 44a which is positioned against the upper surface of the engine body 12 and at the other end thereof with a bifurcation having pressing portions 44b pressing against the upper surface of the flange 13. The portion of the pump body 1 above the flange 13 is formed on its outer periphery with two flat surface portions 45 diametrically opposed to each other and spaced apart from each other a distance substantially corresponding to the spacing between the two pressing portions 44b of the bifurcation. Thus by inserting through the mounting opening 42 of the engine body 12 the lower end portion of the fuel injection pump assembled into a unitary structure beforehand to fit the spring rest 16 in the recess 27 on the upper surface of the tappet 25 and connecting the plate member 44 to the engine body 12 by the bolt 43 after bringing the pressing portions 44b of the plate member 44 into index with the respective flat surface portions 45 of the pump body 1 so that the pressing portions 44b press against the upper surface of the flange 13, it is possible to mount the fuel injection pump in a predetermined position and securely hold same in place.

Figure 6:
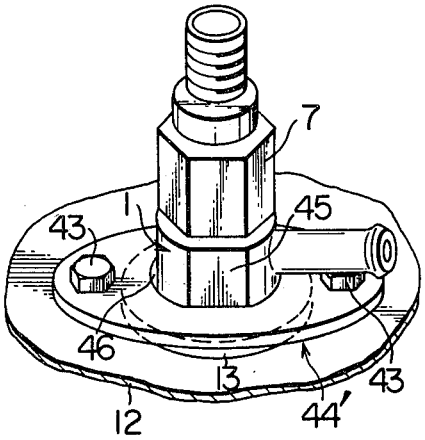
FIG. 6 is a perspective view of the upper portion of the fuel injection pump shown in FIG. 1, showing another form of the pump mounting structure.

FIG. 6 shows a modification of the mounting structure in which a plate member 44' is elliptic in shape and formed in the center with an opening 46 for inserting the portion of the pump body 12 above the flange 13 therethrough. The elliptic plate member 44' is secured at opposite end portions thereof to the engine body 12 by two bolts 43, to thereby secure the pump body 1 to the engine body 12 by pressing the flange 13 against the upper surface of the engine body 12.

The plate members 44 and 44' are preferably formed of spring steel or other resilient metal.

Figure 7:
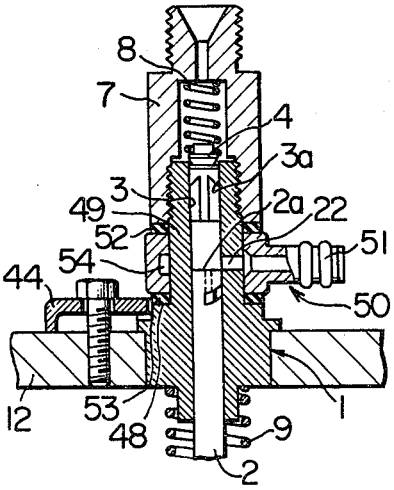
FIG. 7 is a sectional view of the fuel injection pump comprising another embodiment of the invention.
Figure 8:
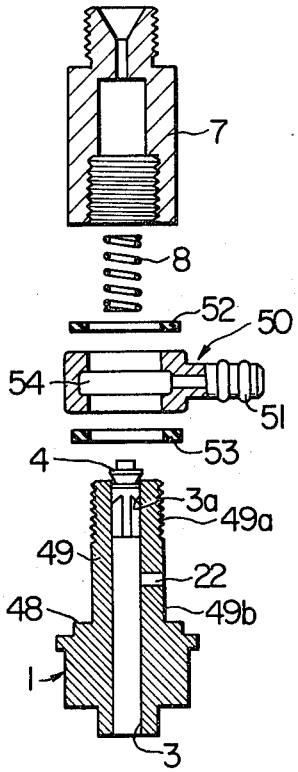
FIG. 8 is an exploded sectional view of the essential portions of the fuel injection pump shown in FIG. 7.

FIGS. 7 and 8 show another embodiment of the fuel injection pump according to the invention. In this embodiment, the pump body 1 includes a minor diameter cylindrical portion 49 disposed above an annular offset 48 formed substantially midway between opposite ends of the pump body 1. The minor diameter cylindrical portion 49 has on its periphery an upper threaded surface 49a and a lower smooth surface 49b, and is formed with a fuel introducing and returning port 22.

A spherical pipe joint 50 including a pipe 51 connected to the fuel introducing and returning port 22 is fitted over the smooth surface 49b of the cylindrical portion 29, with seal members 52 and 53 as of rubber being placed over and beneath the joint 50. Meanwhile the discharge valve retaining collar 7 is threadably fitted over the threaded surface 49a to keep the spherical pipe joint 50 in hermetically sealed condition in being secured to the pump body 1. The pipe 51 has connected thereto a fuel supply line, not shown.

The spherical pipe joint 50 is formed in its interior with a fuel chamber 54 defined between the smooth surface 49b and the joint 50 for the fuel sucked through the pipe 51 or the fuel escaping through the port 22.

The fuel injection pump of the aforesaid constructional form operates in the same manner as the conventional fuel injection pump of the Bosch type, so that description thereof will be omitted.

The fuel injection pump according to the invention can achieve many advantages which will be summarized as follows:

1. The arrangement that the pump body 1 is formed with the plunger sliding bore 3 for allowing the plunger to move in sliding reciprocatory movement therein and the plunger sliding bore 3 has the discharge valve 4 mounted at its end portion 3a corresponding to the upper portion 2a of the plunger 2 so that the discharge valve 4 is guided by the end portion 3a enables the barrel and the discharge valve guide member of a Bosh type fuel injection pump of the prior art to be dispensed with. Thus the invention is conducive to reduced number of parts, reduced size of the pump body 1 and reduced cost and permits the weight of the pump to be greatly reduced as compared with a conventional fuel injection pump of the same capacity.

The elimination of the barrel and discharge valve guide member obviates the problem of the fuel leakage between these parts and greatly simplifies the discharge valve mounting structure.

2. Formation of the disk-shaped flange 13 integrally on the outer periphery of the pump body 1 for positioning and securing the pump body 1 to the engine body 12 facilitates mounting of the pump body 1 on the engine body 12. The provision of the spring seat 10 for the plunger returning spring 9 and the guide cylinder 11 formed integrally with the pump body 1 in its lower portion enables the plunger returning spring mounting structure to be simplified because the pump body 1 serves concurrently as a spring rest for the plunger returning spring 9.

Thus the number of parts can be reduced and an overall compact size can be obtained in a fuel injection pump. At the same time, machining of the pump body is facilitated, and since the pump body 1 is formed of hardenable material, such as case-hardening steel, bearing steel, nitriding steel, etc., hardening of the inner peripheral surface of the plunger sliding bore 3, spring seat 10 and guide cylinder 11 can be effected simultaneously.

3. The arrangement that the plunger 2 is resiliently connected to the pump body 1 to provide a unitary structure by mounting the plunger returning spring 9 at upper and lower ends thereof on the annular engaging surface 11a of the cylindrical guide 11 projecting downwardly from the pump body 1 integrally therewith and the spring rest 16 attached to the lower end of the plunger 2 respectively enables the plunger 2 having the plunger returning spring 9 connected to its lower end portion to be readily assembled with the pump body 1. This facilitates assembling and disassembling of a fuel injection pump, and the formation of the pump body, plunger and plunger returning spring into a unitary structure facilitates attaching and detaching of these parts to the engine body 12.

The plunger returning spring 9 serves concurrently as means for connecting the plunger 2 to the pump body 1 and the use of special connecting means can be eliminated, thereby enabling the number of parts to be reduced. This is conducive to reduced overall size of the fuel injection pump and reduced production cost thereof.

The annular engaging surface 11*a* of the pump body 1 and the outer peripheral surface of the spring rest 16 are formed with the spring securing recesses 18 and 19 respectively, and the plunger returning spring 9 is formed at its upper and lower ends with radially bent portions 20 and 21 respectively, so that the bent portions 20 and 21 can be engated in the spring securing recesses 18 and 19 respectively. This enables the pump body 1, plunger 2 and plunger returning spring 9 to be positively formed into a unitary structure.

By fitting the ring 17 over the plunger 2 in a position immediately above the spring rest 16 so that the ring 17 may contact with the upper surface of the spring rest 16, it is possible to positively prevent dislodging of the plunger 2 by simple means, thereby contributing to a reduction in the number of parts and the size of the pump.

4. The spring rest 16 for the plunger returning spring 9 is loosely fitted over the lower end portion of the plunger 2 and locked in position in such a manner that the annular space S is defined between the inner peripheral surface of the spring rest 16 and the outer peripheral surface of the plunger 2, and the tappet 25 is formed on its upper surface with the recess 27 for receiving the outer periphery 16*a* of the lower end of the spring rest 16. By this arrangement, the spring rest 16 moves vertically with the plunger 2 as a unit while being received in the recess 27 during vertical movement of the tappet 25, so that the spring rest 16 is confined by the recess 27 and prevented from moving radially. Thus during operation of the fuel injection pump, the annular space S exists at all times between the outer periphery of the plunger 2 and the inner periphery of the spring rest 16 and these parts are prevented from coming into contact with each other. This permits rotation of the plunger 2 for adjusting the amount of the injected fuel to be effected readily and smoothly.

The provision of the recess 27 on the upper surface of the tappet 25 for receiving the outer periphery 16*a* of the lower portion of the spring rest 16 enables positioning of the spring rest 16 to be readily effected when the pump body 1 is assembled.

5. The lever 14 for rotating the plunger 2 to adjust the amount of injected fuel is connected to the lower end of the plunger 2, and the notch 28 for permitting the lever 14 to be engaged therein is formed on the upper surface of the tappet 25. The length of the pump body 1 can be reduced by an amount corresponding to the depth of the notch 28, thereby contributing to a reduction in the size of the pump.

The notch 28 has the opposite end surfaces 28*a* and 28*b* functioning to restrict the range of pivotal movement of the lever 14, so that the need to provide special means for regulating the upper and lower limits is eliminated. Also, a member projecting radially, such as the rack of the Bosch type fuel injection pump of the prior art, is eliminated. Thus the number of parts, the size of the pump and production cost can be further reduced.

6. In securing the pump body 1 to the engine body 12 after inserting the latter in the mounting opening 42 formed in the former, the disk-shaped flange 13 of the pump body 1 is pressed by the plate member 44 bolted to the engine body 12 at 43 and held in place. This eliminates the need to form in the pump body 1 a large flange for mounting the pump body 1 on the engine body 12, thereby reducing the size of the pump body 1. Moreover, the pump body 1 together with the flange 13 have an axial circular cross section, thereby facilitating machining.

The arrangement that the pump body 1 is not directly secured to the engine body eliminates the need to form a bolt receiving opening in the pump body 1, allowing the pump body to be installed in a narrow mounting space.

The arrangement that the pump body 1 is pressed against and secured to the pump body 12 by the resilience of the plate member 44 does not require control of the bolt clamping force, enabling the pump body 1 to be mounted readily.

7. The spherical pipe joint 50 having the pipe 51 for connection with a fuel supply line is fitted over the smooth surface 49*b* in the lower portion of the minor diameter cylindrical portion 49 in the upper half portion of the pump body 1 and held in place through the seal members 52 and 53 between the pump body 1 and the discharge valve retaining collar 7 threadably fitted over the threaded surface 49*a* in the upper portion of the minor diameter cylindrical portion 49. This arrangement eliminates the need to use clamping members, etc., for mounting the spherical pipe joint 50. Thus the number of parts can be reduced and machining of mounting screws is unnecessary, resulting in a marked simplification of the pump structure.

The interior of the spherical pipe joint 50 can be used as the fuel chamber 54 for the sucked fuel or escaping fuel, so that a very compact overall size can be obtained in a pump body.

Last but not least important is increased strength of the pump body 1 which results from the absence of pressed-in portions.

What is claimed is:

1. A fuel injection pump of an internal combustion engine comprising:

a pump body;

a disk-shaped flange formed integrally with said pump body at an intermediate portion thereof for positioning and securing said pump body directly to an engine body;

a plunger;

a plunger sliding bore formed in said pump body for receiving said plunger for sliding reciprocatory movement;

a discharge valve mounted on an end portion of said plunger sliding bore corresponding to an upper end portion of said plunger so that said end portion of said plunger sliding bore can guide said discharge valve;

a guide cylinder formed in a lower end portion of said pump body and having an annular engaging surface supporting an upper end portion of a plunger returning spring force fitted thereon; and a spring rest mounted on a lower end of said plunger returning spring force fitted thereon, whereby said pump body and said plunger can be unitarily connected to eafh other through said plunger returning spring, wherein said annular engaging surface of said pump body and an outer peripheral surface of said spring rest are each formed with a spring engaging recess, and said plunger returning spring has radially inwardly bent portions each formed at one of upper and lower ends thereof, said radially inwardly bent portions of said plunger returning spring being received and secured in said spring engaging recess of said pump body and said spring engaging recess of said spring rest.

2. A fuel injection pump of an internal combustion engine comprising:

a pump body;

a disk-shaped flange formed integrally with said pump body at an intermediate portion thereof for positioning and securing said pump body directly to an engine body;

a plunger;

a plunger sliding bore formed in said pump body for receiving said plunger for sliding reciprocatory movement;

a discharge valve mounted on an end portion of said plunger sliding bore corresponding to an upper end portion of said plunger so that said end portion of said plunger sliding bore can guide said discharge valve;

a guide cylinder formed in a lower end portion of said pump body and having an annular engaging surface supporting an upper end portion of a plunger returning spring force fitted thereon; a spring rest mounted on a lower end portion of said plunger for supporting the lower end of said plunger returning spring force fitted thereon, whereby said pump body and said plunger can be unitarily connected to each other through said plunger returning spring; and a ring member fitted over said plunger in a position immediately above said spring rest, said ring member being positioned against an upper surface of said spring rest.

3. A fuel injection pump of an internal combustion engine comprising:

a pump body;

a disk-shaped flange formed integrally with said pump body at an intermediate portion thereof for positioning and securing said pump body directly to an engine body;

a plunger;

a plunger sliding bore formed in said pump body for receiving said plunger for sliding reciprocatory movement;

a discharge valve mounted on an end portion of said plunger sliding bore corresponding to an upper end portion of said plunger so that said end portion of said plunger sliding bore can guide said discharge valve;

wherein said pump body comprises an upper cylindrical portion smaller in diameter than its lower portion and having an outer peripheral surface including an upper threaded surface and a lower smooth surface;

said pump further comprising a fuel introducing and returning port formed in the upper cylindrical portion of said pump body for communicating said plunger sliding bore with the smooth surface of said pump body;

a spherical pipe joint having a pipe for connection with a fuel supply line and fitted over the smooth surface of said pump body for communicating said plunger sliding bore with the pipe; a discharge valve retaining collar threadably fitted over the threaded surface of said pump body; and a pair of seal members fitted over the smooth surface of said pump body, one seal member being interposed between said spherical pipe joint and said discharge valve retaining collar and the other seal member being interposed between said spherical pipe joint and the lower portion of said pump body so as to securedly hold the spherical pipe joint in place.

* * * * *